US009925825B1

(12) United States Patent
Hoffmann, IV et al.

(10) Patent No.: US 9,925,825 B1
(45) Date of Patent: Mar. 27, 2018

(54) PORTABLE AND HANGABLE PAINT TUBE CASE

(71) Applicants: Sterling Peter Hoffmann, IV, Sebastopol, CA (US); Melinda Suzette Bryant, Sebastopol, CA (US)

(72) Inventors: Sterling Peter Hoffmann, IV, Sebastopol, CA (US); Melinda Suzette Bryant, Sebastopol, CA (US)

( * ) Notice: Subject to any disclaimer, the term of this patent is extended or adjusted under 35 U.S.C. 154(b) by 0 days.

(21) Appl. No.: 15/490,452

(22) Filed: Apr. 18, 2017

Related U.S. Application Data

(60) Provisional application No. 62/325,790, filed on Apr. 21, 2016.

(51) Int. Cl.

| | |
|---|---|
| ***B05C 17/00*** | (2006.01) |
| ***B44D 3/04*** | (2006.01) |
| ***A45C 13/30*** | (2006.01) |
| ***A45C 11/00*** | (2006.01) |
| ***B65D 1/02*** | (2006.01) |
| ***B65D 41/02*** | (2006.01) |
| ***A45C 13/10*** | (2006.01) |
| ***A47B 97/08*** | (2006.01) |

(52) U.S. Cl.
CPC ..... *B44D 3/04* (2013.01); *A45C 11/00* (2013.01); *A45C 13/10* (2013.01); *A45C 13/30* (2013.01); *A47B 97/08* (2013.01); *B65D 1/023* (2013.01); *B65D 41/02* (2013.01)

(58) Field of Classification Search
USPC ..... 206/277, 81, 1.7, 1.8, 806; 211/71.01, 211/60.1
See application file for complete search history.

(56) References Cited

U.S. PATENT DOCUMENTS

| | | | | |
|---|---|---|---|---|
| 1,545,786 | A * | 7/1925 | Martin | A45C 11/36 206/1.7 |
| 3,152,697 | A | 12/1963 | Berman | |
| 3,312,442 | A | 4/1967 | Moeller | |
| 3,389,945 | A * | 6/1968 | Thomas | B44D 3/04 206/1.7 |
| 3,446,337 | A * | 5/1969 | Blackmon | B44D 3/04 206/1.7 |
| 4,198,772 | A | 4/1980 | Furuto | |
| 4,406,368 | A * | 9/1983 | Hermes | B43M 99/008 206/1.7 |

(Continued)

FOREIGN PATENT DOCUMENTS

| | | |
|---|---|---|
| CN | 2420148 Y | 2/2001 |
| CN | 201200066 Y | 3/2009 |

(Continued)

*Primary Examiner* — Jacob K Ackun
(74) *Attorney, Agent, or Firm* — Haverstock & Owens LLP

(57) ABSTRACT

A portable carry case that securely holds paint tubes for storage and transport with the added use of hanging the carry case on an easel for ease of use during painting sessions. The carry case brings organization and efficiency to the artist while also reducing stress, both physically and mentally, on the artist as the paint tubes are readily available for use, organized to eliminate searching for particular colors and being housed in the case they can easily be put away for transport by simply securing the straps and removing the entire carry case from where it is hung for placement in a pack or other carrying device by the artist.

19 Claims, 14 Drawing Sheets

(56) References Cited

U.S. PATENT DOCUMENTS

| | | | | | |
|---|---|---|---|---|---|
| 4,682,688 | A | | 7/1987 | Budert | |
| 4,947,984 | A | | 8/1990 | Kaufman et al. | |
| 4,991,711 | A | * | 2/1991 | Cheng | B44D 3/04 206/1.7 |
| 5,704,495 | A | * | 1/1998 | Bale | A61B 50/20 211/71.01 |
| 5,779,033 | A | | 7/1998 | Roegner | |
| 5,890,605 | A | * | 4/1999 | Percudani | A47B 67/00 211/119.009 |
| 5,947,297 | A | | 9/1999 | Aoki et al. | |
| 6,206,183 | B1 | * | 3/2001 | Helsel | A47B 97/08 206/1.7 |
| 6,227,387 | B1 | | 5/2001 | Rose | |
| 6,298,995 | B1 | * | 10/2001 | Schwester | B65D 5/50 206/277 |
| 7,419,320 | B2 | * | 9/2008 | LaBrasca | A45C 11/34 206/1.7 |
| 2003/0042262 | A1 | * | 3/2003 | Young | B44D 3/02 220/570 |
| 2005/0183970 | A1 | * | 8/2005 | Lalino | B44D 3/02 206/1.8 |

FOREIGN PATENT DOCUMENTS

| | | | |
|---|---|---|---|
| JP | 3139141 | B2 | 2/2001 |
| JP | 2005119736 | A | 5/2005 |
| JP | 2007215971 | A | 8/2007 |

* cited by examiner

PORTABLE AND HANGABLE PAINT TUBE CASE

RELATED APPLICATIONS

This Patent Application claims priority under 35 U.S.C. 119 (e) of the U.S. Provisional Application Ser. No. 62/325,790, filed Apr. 21, 2016, and entitled "PORTABLE AND HANGABLE PAINT TUBE CASE". This application incorporates U.S. Provisional Application Ser. No. 62/325,790 in its entirety by reference.

FIELD OF THE INVENTION

The present invention is generally directed to the fields of carrying cases and paint supplies. More specifically, the present invention is directed to a portable and hangable paint tube carry case.

BACKGROUND OF THE INVENTION

Artists painting on location have a need to transport their painting supplies to the location. While there are a variety of conventional containers made to hold artist paint tubes for transport, storage and use, these containers do not always allow for sufficient organization and/or arrangement that enables easy retrieval during painting sessions. Many artists keep their paint tubes in a transport container such as a back pack or other type pack. Typical containers only allow for the paint tubes to be randomly piled into the container where an artist will subsequently need to rummage through this pile of paint tubes searching for the needed color. Such disorganization results in not only inefficiency when trying to locate particular colors to reload the painting palette, but it can also create mental stress as well as physical harm by the continual bending over to locate particular paint tubes within the container. Another drawback of typical transport containers where the paint tubes are kept all together is that the container does not offer protection for the individual paint tubes. This causes the paint tubes to chafe against each other wearing off the defining words on the paint tubes, rendering them indistinguishable one from another. In such a circumstance, the paint tubes need to be opened in order to determine the color in any given tube. This can cause mental stress and frustration from time lost searching for a particular color as well as breaking the artists concentration, hampering the flow of putting paint to canvas during painting sessions. Paint leakage through breaks in the tubes is also a result of this friction bringing more confusion as the leakage covers other paint tubes.

Another way paint tubes are stored and used is with a box or drawer built into an artist's palette, but this still creates the same dilemma of locating needed colors especially if the words have rubbed off as a result of the paint tubes continually chafing against each other. In any of these cases, precious time is lost searching for needed colors especially if an artist is working "on location" and depends on the light of the sun in order to successfully complete a painting.

SUMMARY OF THE INVENTION

The present invention addresses the problems in the prior art with a portable carry case that securely holds paint tubes for storage and transport with the added use of hanging the carry case for ease of use during painting sessions. The carry case brings organization and efficiency to the artist while also reducing stress, both physically and mentally, on the artist as the paint tubes are readily available for use, organized to eliminate searching for particular colors and being housed in the case they can easily be put away for transport by simply securing the straps and removing the entire carry case from where it is hung for placement in a pack or other carrying device by the artist. Although described herein as a carry case configured to store paint tubes, it is understood that the carry case can generally be used for storing any objects of a predetermined size and shape.

The system utilizing the portable carry cases is designed to eliminate frustration and lost time for the artist. While on location, it allows an artist to easily locate individual paint tubes quickly from a portable protective carry case hung from an easel. Paint tubes are organized for quick inventory, easy to find what is available and what is missing. The carry case is lightweight and hangs on the easel with hooks from the back and holds multiple paint tubes securely with one or more straps. Each paint tube can be easily lifted for use and returned to its designated notch when it is not needed. When it is time to move onto the next location the paint tube carry cases are easily lifted from the easel, placed into a common bag that can hold two carry cases or strapped together using an elongated strap, and slipped into a back pack or other transport container. The one or more straps securing the paint tubes provide protection from paint tubes chafing against each other or other materials.

In an aspect, a portable carry case is disclosed for organizing and securing one or more objects in designated positions and for hanging the carry case in place. The carry case includes a case having a body, a base extending from a front side and a first end of the body and a cornice extending from the front side and a second end of the body. The cornice includes one or more notches, each notch configured to receive a corresponding one of the one or more objects mounted therein. The body includes a plurality of slots. The carry case also includes a plurality of hooks extending from a back side of the body. One or more straps are attached to the case at the plurality of slots. The one or more straps are configured to wrap around the one or more objects mounted into the one or more notches to secure the one or more objects in place within the carry case. In some embodiments, each object has a neck portion and a head portion coupled to the neck portion, wherein the head portion is wider than the neck portion and the neck portion is configured to slide within the notch of the cornice and the head portion is configured to rest against the cornice so that the object hangs within the carry case. In some embodiments, the neck portion includes an opening at an end of the neck through which contents of the object are input and output, and the head portion comprises a cap configured to be removably coupled to the end of the neck. In some embodiments, the notches of the cornice are an equidistant space apart from each other. In some embodiments, the plurality of slots comprises two slots, each slot is positioned an equidistant space apart from side edges of the body. In some embodiments, the plurality of hooks comprises two hooks, each hook is positioned an equidistant space apart from side edges of the body. In some embodiments, the case is formed from a rectangular shaped sheet bent at a first end to form the cornice and bent at a second end to form the base. In some embodiments, the cornice extends away from the body by a same distance as the base extends from the body. In some embodiments, the one or more straps comprise a single strap, a first end of the strap includes a first fastener and a second end of the strap includes a second fastener to be mated to the first fastener, further wherein the strap is inserted through the plurality of slots to attach the strap to the carry case, and the first end of the strap and the second end of the strap wrap around the one or more objects mounted within the one or more notches such that the first fastener is mated to the second fastener. In some embodiments, the first fastener comprises a loop patch and the second fastener comprises a hook patch. In other embodiments, the one or more straps comprise two straps, a first end of the first strap includes a first fastener and a second end of the first strap includes a first fastener pair to be mated to each other, and a first end of the second strap includes a second fastener to be mated to the first fastener of the first strap and a second end of the second strap includes a second fastener pair to be mated to each other, further wherein the second end of the first strap is inserted through a first slot of the plurality of slots such that the first fastener pair are mated to each other to attach the first strap to the carry case, the second end of the second strap is inserted through a second slot of the plurality of slots such that the second fastener pair are mated to each other to attach the second strap to the carry case, and the first end of the first strap and the first end of the second strap wrap around the one or more objects mounted within the one or more notches such that the first fastener of the first strap is mated to the second fastener of the second strap. In some embodiments, each hook comprises multiple mounting channels each having a different channel width for mounting to different sized mounting structures. In some embodiments, the case comprises plastic or metal. In some embodiments, the carry case further comprises a removable shim mounted to the back side of the body. In some embodiments, the plurality of hooks are integrally formed with the body. In some embodiments, the plurality of hooks are separately formed from the body and are bonded to the body. In some embodiments, the plurality of hooks are separately formed from the body and the body includes a plurality of hook slots, wherein a corresponding one hook of the plurality of hooks is inserted through a corresponding one of the plurality of hook slots.

In another aspect, a pair of portable carry cases is disclosed for organizing and securing one or more objects in designated positions and for hanging each carry case in place. The pair of carry cases include a first carry case and a second carry case. The first carry case includes a first case, a plurality of first hooks and one or more first straps. The first case has a first body, a first base extending from a front side and a first end of the first body and a first cornice extending from the front side and a second end of the first body. The first cornice includes one or more first notches, each first notch configured to receive a corresponding one of the one or more objects mounted therein. The first body includes a plurality of first slots. The plurality of first hooks extends from a back side of the first body. The one or more first straps are attached to the first case at the plurality of first slots, wherein the one or more first straps are configured with two fastening positions. The second carry case includes a second carry case, a plurality of second hooks and one or more second straps. The second case has a second body, a second base extending from a front side and a first end of the second body and a second cornice extending from the front side and a second end of the second body. The second cornice includes one or more second notches, each second notch configured to receive a corresponding one of the one or more objects mounted therein. The second body includes a plurality of second slots. The plurality of second hooks extends from a back side of the second body. The one or more second straps are attached to the second case at the plurality of second slots, wherein the one or more second straps are configured with two fastening positions. The second carry case is fitted against the first carry case with the one or more objects mounted in the first carry case facing the one or more objects mounted in the second carry case. The one or more second straps are wrapped around the one or more objects mounted into the one or more second notches to secure the one or more objects in place within the second carry case. The one or more first straps are wrapped around the second carry case to secure together the first carry case and the second carry case.

In yet another aspect, a portable carry case is disclosed for organizing and securing one or more paint tubes in designated positions and for hanging the carry case in place against a side of a portable easel. The portable easel has a bottom box with side walls. Each of the one or more paint tubes includes a neck at one end of the paint tube, the neck having an opening at a first end for dispensing paint from the paint tube, and a cap removably coupled to the first end of the neck. The carry case includes a case, a plurality of hooks and one or more straps. The case has a body, a base extending from a front side and a first end of the body and a cornice extending from the front side and a second end of the body. The cornice includes one or more notches. Each notch is configured to receive the neck of a corresponding one of the one or more paint tubes mounted therein. The cap of the corresponding one paint tube rests against the cornice to suspend the corresponding one paint tube in place. The body includes a plurality of slots. The plurality of hooks extends from a back side of the body, each hook configured to hang from a side wall of the portable easel. The one or more straps are attached to the carry case at the plurality of slots. The one or more straps are configured to wrap around the one or more paint tubes mounted into the one or more notches to secure the one or more paint tubes in place within the carry case.

BRIEF DESCRIPTION OF THE DRAWINGS

Several example embodiments are described with reference to the drawings. The example embodiments are intended to illustrate, but not to limit, the invention. The drawings include the following figures.

DETAILED DESCRIPTION OF THE EMBODIMENTS

Embodiments of the present application are directed to a paint tube carry case. Those of ordinary skill in the art will realize that the following detailed description of the paint tube carry case is illustrative only and is not intended to be in any way limiting. Other embodiments of the paint tube carry case will readily suggest themselves to such skilled persons having the benefit of this disclosure.

Reference will now be made in detail to implementations of the paint tube carry case as illustrated in the accompanying drawings. The same reference indicators will be used throughout the drawings and the following detailed description to refer to the same or like parts. In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
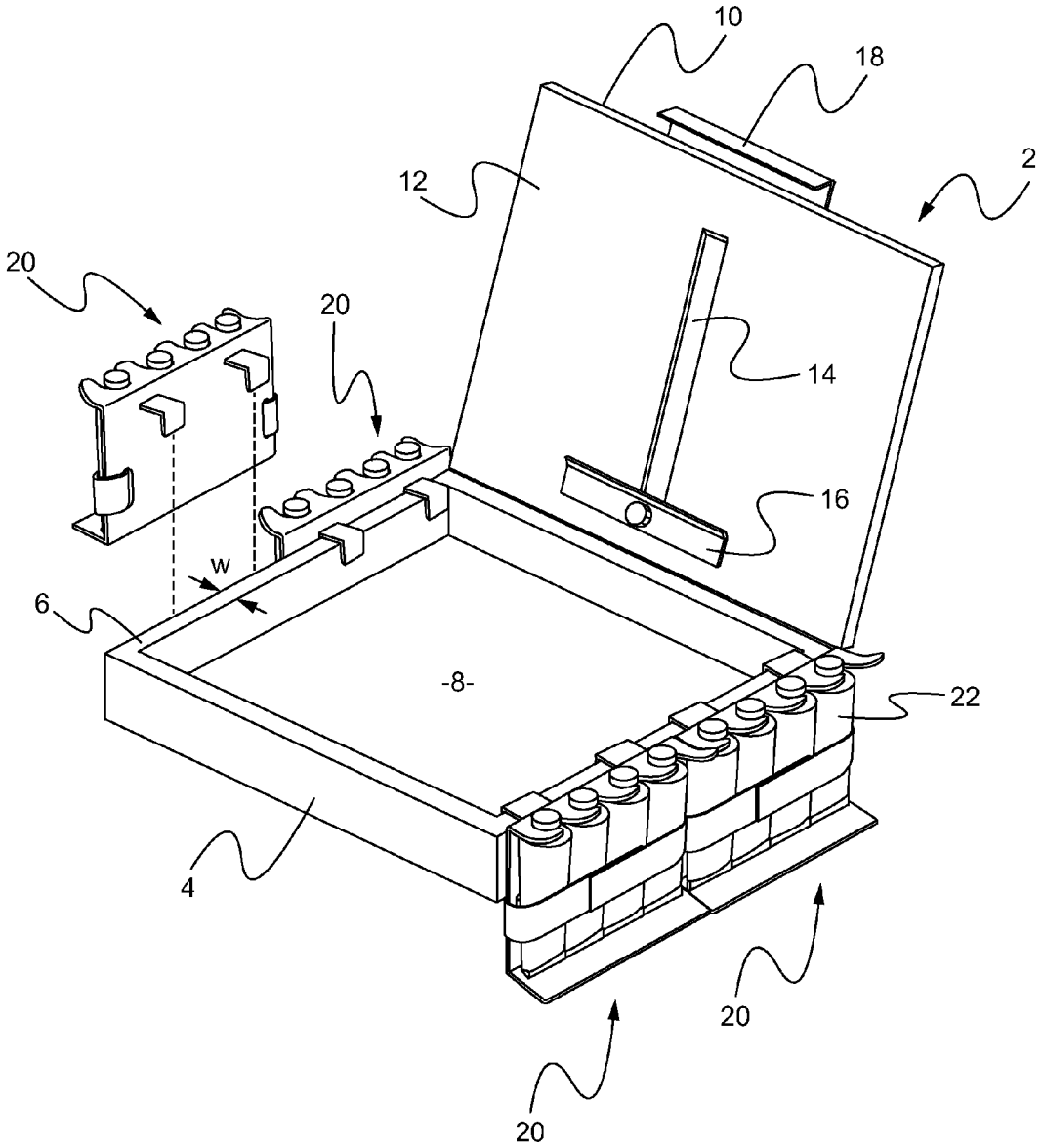
FIG. 1 illustrates a perspective view of a portable easel including mounted carrying cases according to an embodiment.

FIG. 1 illustrates a perspective view of a portable easel including mounted carrying cases according to an embodiment. A portable easel includes both an easel for mounting a canvas and a palette, typically connected to each other. In the exemplary configuration shown in FIG. 1, a portable easel 2 includes a bottom box 4 having sides walls 6 and a bottom panel. An interior bottom surface 8 of the bottom panel is used as a palette. The portable easel 2 also includes a top cover 10 mounted to the bottom box 4. In some embodiments, the top cover 10 is mounted to one of the side walls 6 using hinges so as to enable the top cover 10 to rotate closed against the bottom box 4 and to rotate open as shown in FIG. 1. When the portable easel 2 is in the open position, one or more carry cases 20 can be mounted to the side walls 6. Each carry case 20 is configured to hold in place one or more paint tubes 22.

An interior surface 12 of the top cover 10 can be used as a mounting surface for a canvas (not shown). A slot 14 is formed in the interior surface 12 and a bracket 16 is mounted within the slot 14. The bracket 16 can be moved up and down within the slot 14, and secured in a desired position, to match a dimension of the canvas and to secure the canvas against a bracket 18. The bracket 18 is mounted to an exterior surface of the top cover 10. In some embodiments, the bracket 18 is mounted in a permanent fixed position. In other embodiments, the bracket 18 can be movable and fixed in different relative positions. For example, a slot similar to the slot 14 can be formed in the exterior surface and the bracket 18 can be moved up and down within the slot and secured in a desired position.

Figure 2:
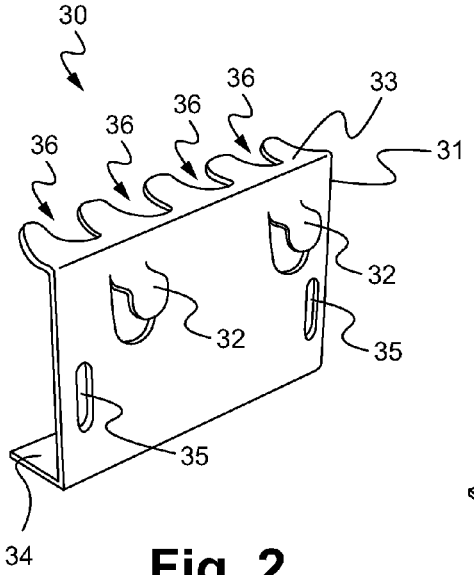
FIG. 2 illustrates a back side perspective view of a carry case according to an embodiment.

In general, a carry case is configured to have hanging brackets for mounting the carry case to a side wall of the portable easel, notches for receiving and organizing paint tubes, one or more straps for securing the paint tubes within the notches, and slots for mounting the one or more straps. In some embodiments, the carry case is made of plastic. In other embodiments, the carry case is made of metal. It is understood that alternative materials can be used to make the carry case. FIG. 2 illustrates a back side perspective view of a carry case according to an embodiment. The carry case 30 has a body 31, a base 34 extending from one end of the body 31, and a cornice 33 extending from an opposite end of the body 31. A cornice includes one or more notches. In the exemplary configuration shown in FIG. 2, the cornice 33 includes four notches 36. Each notch 36 is configured to receive a corresponding paint tube. A width of each notch 36 is wide enough for a neck of the paint tube to slide into the notch 36, but narrower than a diameter of a paint tube cap (see FIG. 18) so as to enable the paint tube cap to rest against the cornice 33 without falling through the notch 36. Slots 35 are formed in the body 31. One or more straps are attached to the carry case 30, as described in greater detail below. One or more hanging brackets extend from a back side surface of the body 31. In the exemplary configuration shown in FIG. 2, two hanging brackets 32 extend from the body 31. The hanging brackets 32 are integrally formed with the body 31. In some embodiments, the carry case 30 is manufactured by a die cut thermoforming process. It is understood that alternative manufacturing processes can be used. Such alternative manufacturing processes may result in slightly different configurations of the carry case.

Figure 3:
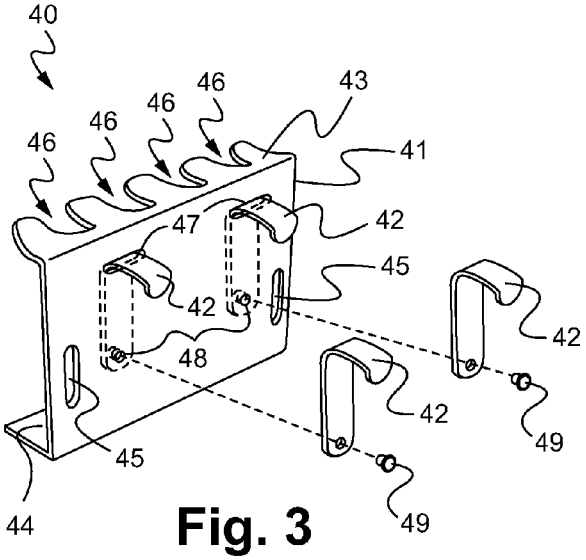
FIG. 3 illustrates a back side perspective view of an alternatively configured carry case according to an embodiment.

FIG. 3 illustrates a back side perspective view of an alternatively configured carry case according to an embodiment. The carry case 40 shown in FIG. 3 is similar in form and function to the carry case 30 in FIG. 2 with alternatively formed hanging brackets. The hanging brackets 42 are formed separately from the body 41. The body 41 includes slots 47 and holes 48. One hanging bracket 42 passes through a corresponding slot 47 such that a first end of the hanging bracket 42 extends from a back side surface of the body 41 and second end of the hanging bracket 42 is positioned against a front side surface of the body 41. The second end of the hanging bracket 42 is secured in place by a rivet 49 passing through the hole 48. The hanging bracket 42 can be removed from the body 41 by removing the rivet 49 and sliding the second end of the hanging bracket 42 through the slot 47. The carry case 40 also includes a base 44 extending from one end of the body 41, and a cornice 43 extending from an opposite end of the body 41. The cornice 43 includes notches 46. Slots 45 are formed in the body 41 for attaching one or more straps to the carry case 40. In some embodiments, the carry case 40 is manufactured by a die cut thermoforming process, where the body 41, cornice 43 and base 44 are formed as a single piece and each hanging bracket 42 is formed as a separate piece. It is understood that alternative manufacturing processes can be used.

Figure 4:
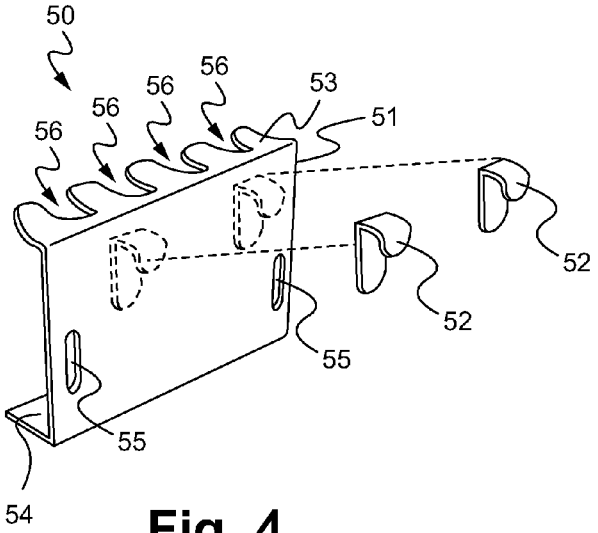
FIG. 4 illustrates a back side perspective view of another alternatively configured carry case according to an embodiment.

FIG. 4 illustrates a back side perspective view of another alternatively configured carry case according to an embodiment. The carry case 50 shown in FIG. 4 is similar in form and function to the carry case 30 in FIG. 2 with alternatively formed hanging brackets. The hanging brackets 52 are formed separately from the body 51. Each hanging bracket 52 is bonded to the back side surface of the body 51. The carry case 50 also includes a base 54 extending from one end of the body 51, and a cornice 53 extending from an opposite end of the body 51. The cornice 53 includes notches 56. Slots 55 are formed in the body 51 for attaching one or more straps to the carry case 50. In some embodiments, the carry case 50 is manufactured by a die cut thermoforming process, where the body 51, cornice 53 and base 54 are formed as a single piece and each hanging bracket 52 is formed as a separate piece. It is understood that alternative manufacturing processes can be used.

Figure 5:
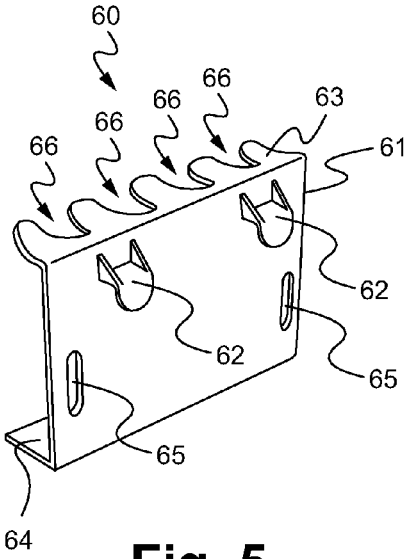
FIG. 5 illustrates a back side perspective view of yet another alternatively configured carry case according to an embodiment.

FIG. 5 illustrates a back side perspective view of yet another alternatively configured carry case according to an embodiment. The carry case 60 shown in FIG. 5 is similar in form and function to the carry case 30 in FIG. 2 with alternatively formed hanging brackets. The hanging brackets 62 are integrally formed with the body 61. The carry case 60 also includes a base 64 extending from one end of the body 61, and a cornice 63 extending from an opposite end of the body 61. The cornice 63 includes notches 66. Slots 65 are formed in the body 61 for attaching one or more straps to the carry case 60. In some embodiments, the carry case 60 is manufactured by an injection molding process, where the body 61, hanging brackets 61, cornice 63 and base 64 are formed as a single piece. It is understood that alternative manufacturing processes can be used.

Figure 6:
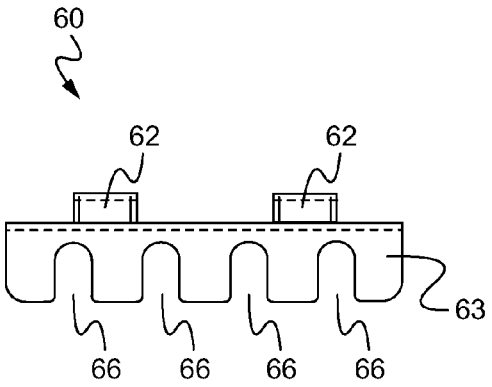
FIG. 6 illustrates a top down view of the carry case 60 of FIG. 5.
Figure 7:
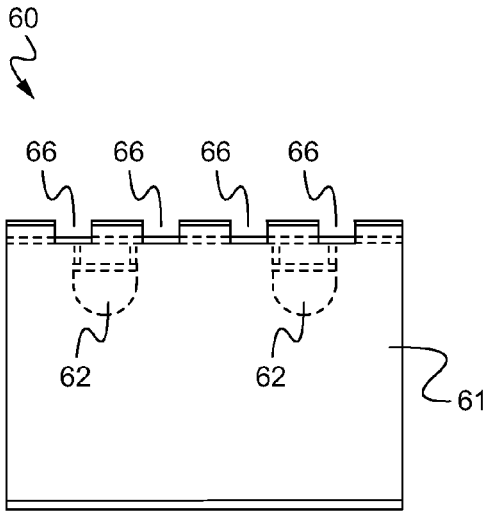
FIG. 7 illustrates a front view of the carry case 60 of FIG. 5.

FIG. 6 illustrates a top down view of the carry case 60 of FIG. 5. FIG. 7 illustrates a front view of the carry case 60 of FIG. 5. As shown in FIGS. 6 and 7, the notches 66 are uniformly spaced from each other, and are each uniformly angled from the opening to the curved interior end. It is understood that alternative configurations of the notches are also contemplated. For example, the notches do not all have to be uniformly spaced from each other. Each notch can also have an alternative shape or taper as long as the notch can receive the neck of the paint tube and the cap of the paint tube can span at least a portion of the notch so as to rest against the cornice.

Figure 8:
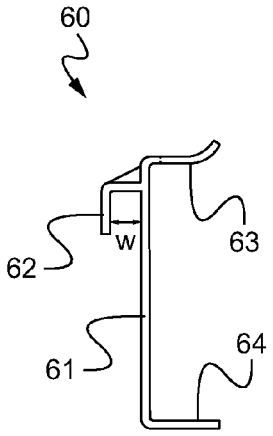
FIG. 8 illustrates a side view of the carry case 60 of FIG. 5.
Figure 9:
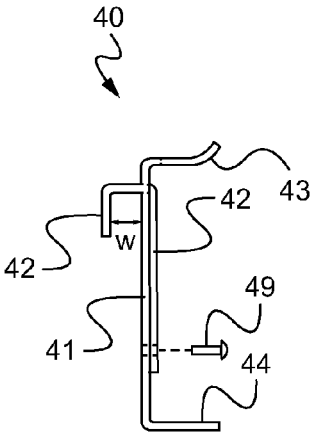
FIG. 9 illustrates a side view of the carry case 40 of FIG. 3 with a channel of width W formed between the hanging bracket and the body.
Figure 11:
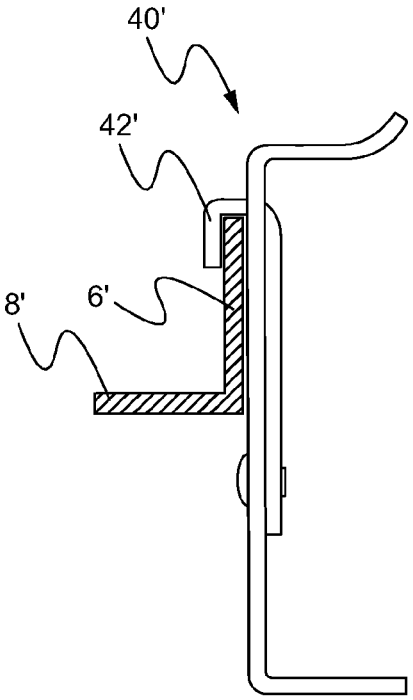
FIG. 11 illustrates a side view of a carry case 40' and a cut out side view of a portion of a portable easel 2' showing the carry case 40' mounting to the portable easel 2'.
Figure 10:
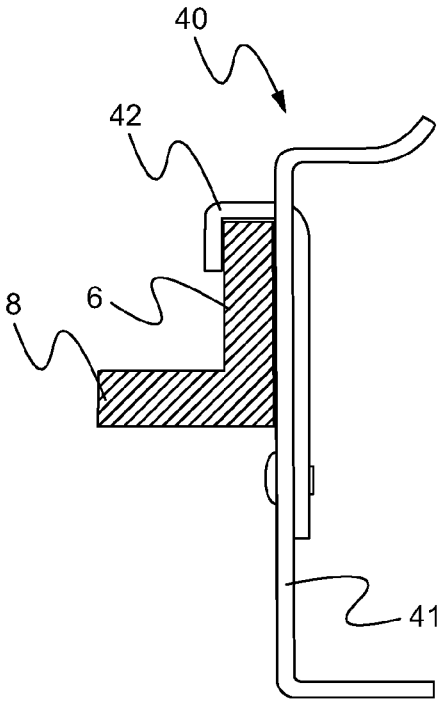
FIG. 10 illustrates the side view of the carry case 40 and a cut out side view of a portion of the portable easel 2 showing the carry case 40 mounting to the portable easel 2.

FIG. 8 illustrates a side view of the carry case 60 of FIG. 5. The hanging bracket 62 extends from the back side surface of the body 61, forming a channel of width W. The hanging brackets of the alternatively configured carry cases also form a channel with width W. For example, FIG. 9 illustrates a side view of the carry case 40 of FIG. 3 with a channel of width W formed between the hanging bracket 42 and the body 41. The channel width W substantially matches the width of the side wall 6 of the portable easel 2 (FIG. 2) so that the side wall 6 fits within the channel formed by the hanging bracket and the carry case body. FIG. 10 illustrates the side view of the carry case 40 and a cut out side view of a portion of the portable easel 2 showing the carry case 40 mounting to the portable easel 2. The side wall 6 fits within the channel formed between the hanging bracket 42 and the body 41. It is known that there are differently sized portable easels. For example, the carry case 40 may have the hanging bracket 42 configured with channel width W that matches a side wall width of French, EasyL, Box M easels and most wooden pochade boxes. It is understood that the carry case can be alternatively configured to have hanging brackets with different channel widths to accommodate different sized portable easels. FIG. 11 illustrates a side view of a carry case 40' and a cut out side view of a portion of a portable easel 2' showing the carry case 40' mounting to the portable easel 2'. The carry case 40' is the same as the carry case 40 except that each hanging bracket 42' is alternatively configured to have a narrower channel width than that of the carry case 40. The narrower channel width of the carry case 40' accommodates the portable easel 2' having a narrower side wall 6', such as that found in a Strada easel.

Figure 12:
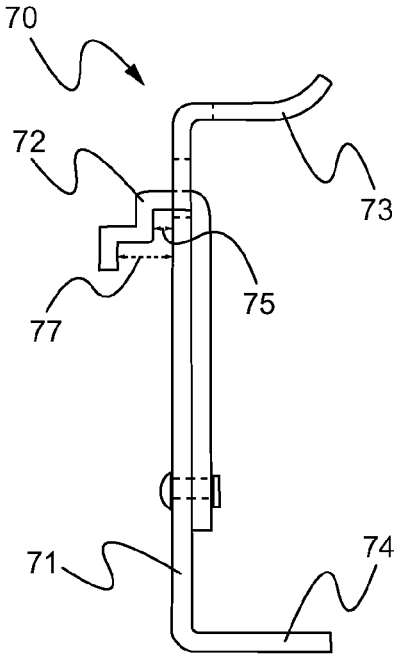
FIG. 12 illustrates a side view of an alternatively configured carry case according to an embodiment.
Figure 13:
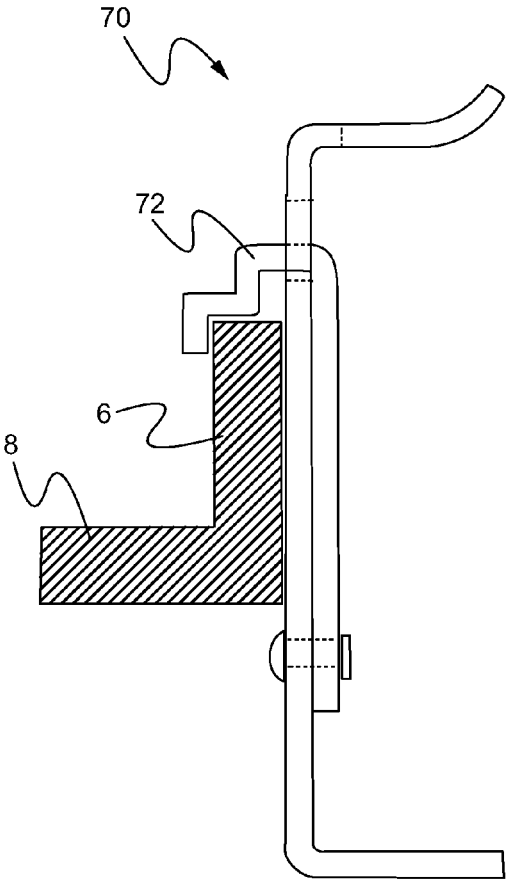
FIG. 13 illustrates the side view of the carry case 70 and the cut out side view of the portion of the portable easel 2 showing the carry case 70 mounting to the portable easel 2.
Figure 14:
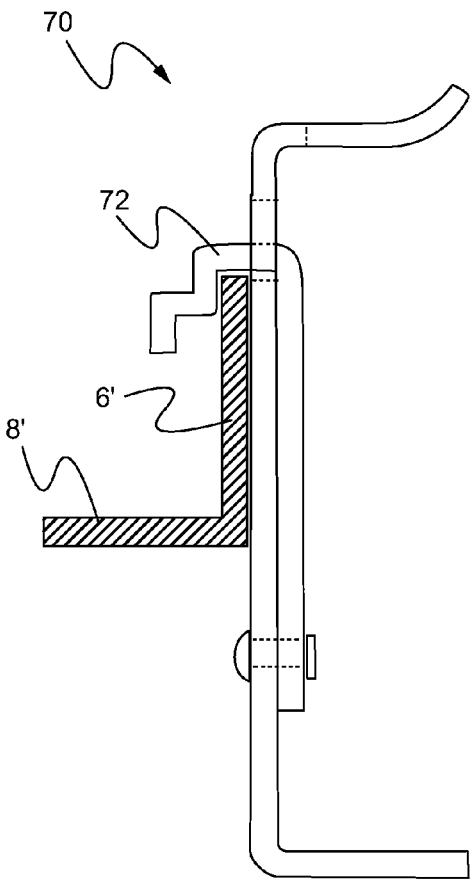
FIG. 14 illustrates the side view of the carry case 70 and the cut out side view of the portion of the portable easel 2' showing the carry case 70 mounting to the portable easel 2'.

In the embodiments above, the hanging brackets are configured with a single channel width. In other embodiments, the hanging brackets are alternatively configured with multiple channel widths. Such configurations provide a type of universal configuration that enables the carry case to be mounted to different sized portable easels. FIG. 12 illustrates a side view of an alternatively configured carry case according to an embodiment. The carry case 70 shown in FIG. 12 is similar in form and function to the carry case 40 in FIG. 3 with alternatively formed hanging brackets. The carry case 70 includes a body 71 with slots and holes for mounting hanging brackets, a cornice 73 with notches formed therein, a base 74 and hanging brackets 72. The hanging brackets 72 shown in FIG. 12 are configured with two channels having different widths, a narrower width 75 for receiving a first type of portable easel and a wider width 77 for receiving a second type of portable easel. For example, the narrower width 75 can be the same as the channel width shown in FIG. 11 and the wider width 77 can be the same as the channel width shown in FIG. 10. FIG. 13 illustrates the side view of the carry case 70 and the cut out side view of the portion of the portable easel 2 showing the carry case 70 mounted to the portable easel 2. In this case, the side wall 6 fits within the channel having channel width 77. FIG. 14 illustrates the side view of the carry case 70 and the cut out side view of the portion of the portable easel 2' showing the carry case 70 mounting to the portable easel 2'. In this case, the side wall 6' fits within the channel having channel width 75.

In the embodiments above, the hooked ends of the hanging bracket are fixed in position when the carry case is mounted to an easel, and the hooked end is substantially parallel with the surface of the body. The resulting channel width is constant along the entire length of the channel and is predetermined to match a width of a specific type of easel side wall. Alternatively, the hooked end of the hanging brackets can be tapered toward the body, and bendable away from the body when mounted to the easel. In such a configuration, the tapered hooked end provides a spring loaded mount to the easel and can accommodate differently sized easels.

Figure 30:
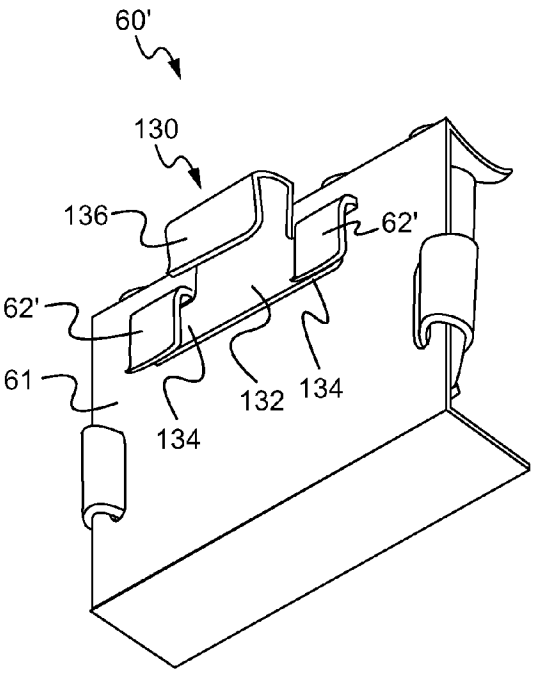
FIGS. 29 and 30 illustrate back side perspective views of yet another alternatively configured carry case and an adaptor hook according to an embodiment.
Figure 29:
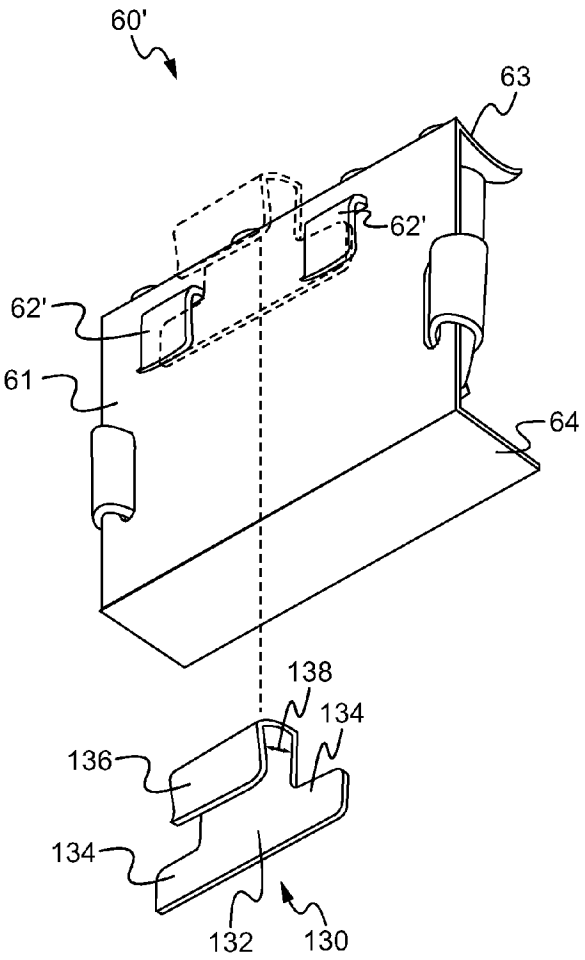

In some embodiments, the carry case is adapted for mounting to an alternatively sized easel side wall by using an adaptor hook configured to be removably mounted to the hooks of any of the carry case types described herein. FIGS. 29 and 30 illustrate back side perspective views of yet another alternatively configured carry case and an adaptor hook according to an embodiment. The carry case 60' shown in FIGS. 29 and 30 is similar in form and function to the carry case 60 in FIG. 5 with hanging brackets 62' having a different shape than those hanging brackets 62 shown in FIG. 5. The hanging brackets 62' are integrally formed with the body 61. The adaptor hook 130 includes a body 132 and flanges 134 extending from both sides of a bottom end of the body 132. Each flange 134 is configured to slide into the channel formed between the hook 62' and the body 61, as shown in FIG. 30. The adaptor hook 130 also includes hooked end 136 that forms a channel width 138. The channel width 38 is sized according to an easel having a side wall width of known dimension. Numerous different adaptor hooks can be provided, with each different adaptor hook having a differently sized channel width to fit one of a variety of known easel side wall widths.

In some embodiments, the hanging brackets themselves are made to be removable from the body of the carry case. For example, the hanging brackets 42 of the carry case 40 in FIG. 3 can be made to be removably coupled to the body 41, such as by replacing the rivet 49 with a screw or some other type of removable coupling mechanism. In such a case of removable hanging brackets, multiple different hanging brackets can be provided each having a different channel width. In this manner, a proper hanging bracket can be selected and attached to the carry case so that a properly sized channel width is provided to match the easel side wall width to which the carry case is to be mounted.

Figure 31:
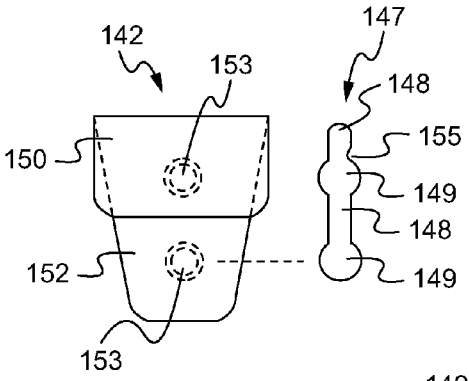
FIG. 31 illustrates a front view of an alternative removable hanging bracket and mounting mechanism according to an embodiment.
Figure 32:
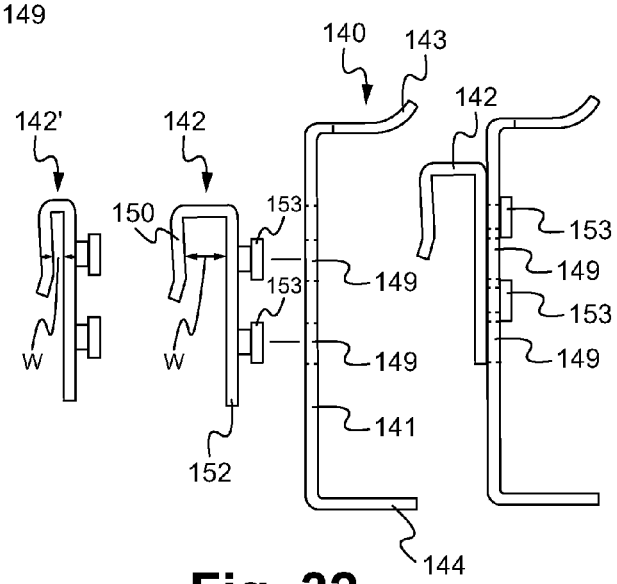
FIG. 32 illustrates a side view of the alternative hanging bracket of FIG. 31 and a corresponding carry case with a corresponding mounting mechanism for the alternative hanging bracket according to an embodiment.
Figure 33:
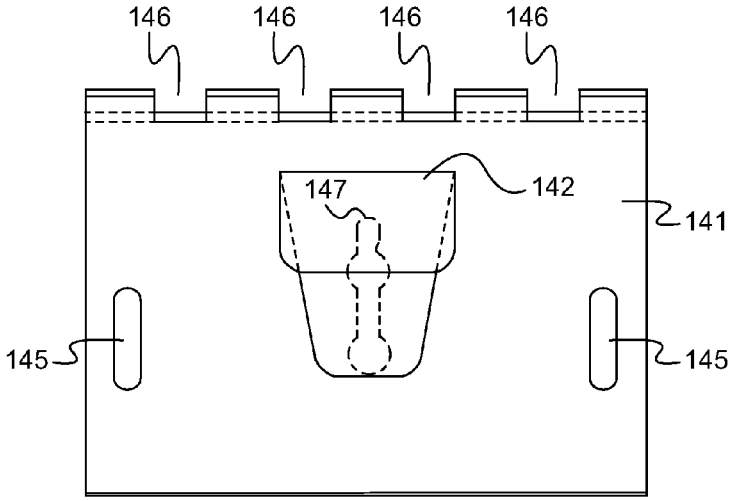
FIG. 33 illustrates a back side view of the carry case 140 with the mounted hanging bracket 142.

Other types of removable handing brackets are also contemplated. FIG. 31 illustrates a front view of an alternative removable hanging bracket and mounting mechanism according to an embodiment. FIG. 32 illustrates a side view of the alternative hanging bracket of FIG. 31 and a corresponding carry case with a corresponding mounting mechanism for the alternative hanging bracket according to an embodiment. The hanging bracket 142 includes a body 152 and a hooked end 150. Nodes 153 extend from a back side of the body 152. A keyhole slot 147 is formed in a body 141 of a carry case 140. The carry case 140 also includes a cornice 143 having notches 146 (FIG. 33) and a base 144 and is similar in form and function as any of the previously described carry cases, which the exception of the following mounting mechanism. The hanging bracket 142 is removable mounted to the body 141 using the keyhole slot 147. The keyhole slot 147 includes node holes 149, the number and alignment of which matches the number of nodes 153 on the back of the hanging bracket 142. In the exemplary configuration of FIGS. 31 and 32, there are two nodes 153 and a corresponding two node holes 149. It is understood that more or less than two nodes and node holes can be used. The keyhole slot 147 also includes channels 148. The hanging bracket 142 is mounted to the body 141 by aligning the nodes 153 of the hanging bracket 142 with the node holes 149 formed in the body 141, as shown in the middle of FIG. 32, and then inserting the nodes 153 through the node holes 149. Once the nodes 153 are inserted through the node holes 153, the hanging bracket 142 is forced upward, as shown in the right hand side of FIG. 32, along channels 148. The hanging bracket 142 is secured in place by a cam 155 that extends into the channel 148. FIG. 33 illustrates a back side view of the carry case 140 with the mounted hanging bracket 142. FIG. 33 shows an embodiment where the carry case has a single hanging bracket 142. It is understood that the carry case can be configured to have more than one removable hanging bracket. Hanging brackets with different sized channels can be used, such as the alternative hanging bracket 142' with narrower channel width, as shown in the left hand side of FIG. 32.

Figure 16:
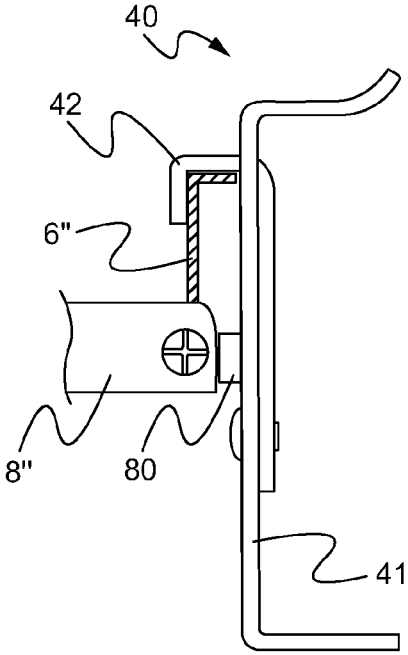
FIG. 16 illustrates a side view of the carry case 40 of FIG. 15 mounted to an irregularly shaped portable easel.
Figure 15:
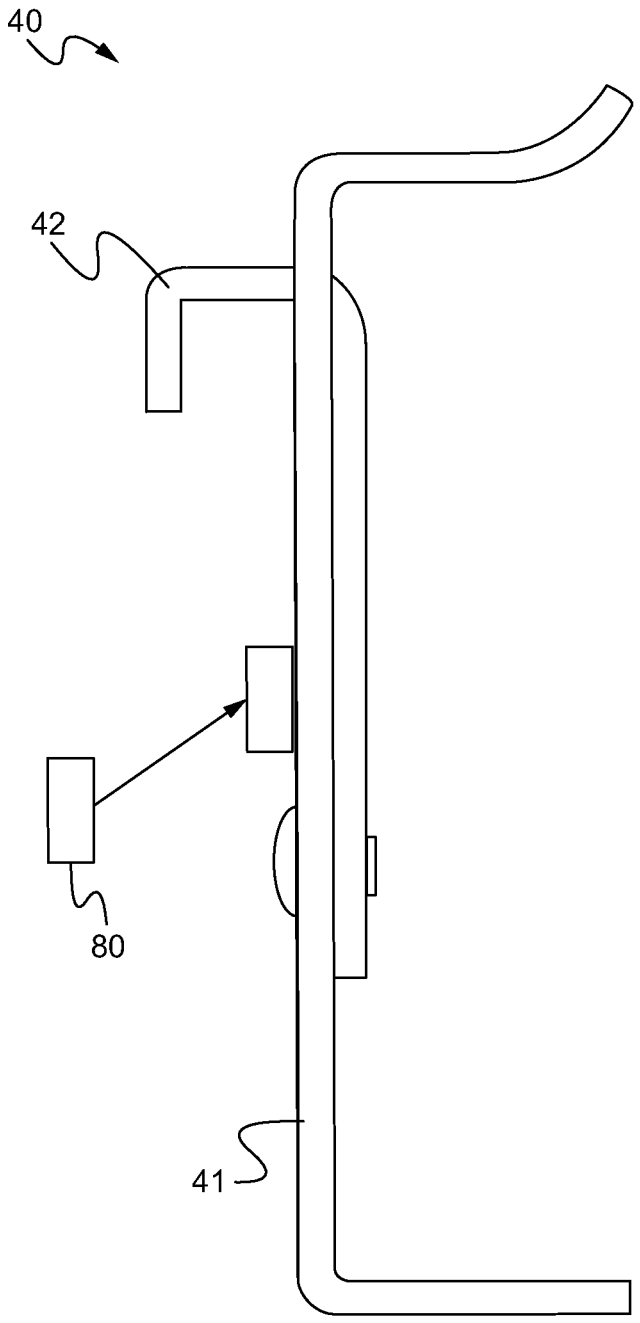
FIG. 15 illustrates a side view of the carry case 40 of FIG. 3 with the addition of a shim.

Some portable easels have irregularly shaped side walls that do not provide a single flat surface for contacting the back side surface of the carry case body. In such configurations, the carry case may not be vertically aligned when mounted to the portable easel. However, it may be desirable to have the carry case properly vertically aligned as shown in FIG. 1. A shim can be used to properly align the carry case in such circumstances. FIG. 15 illustrates a side view of the carry case 40 of FIG. 3 with the addition of a shim 80. The shim 80 can be removably mounted, such as by adhesive, to the back side of the base 41. The shim 80 enables the carry case 40 to be vertically aligned relative to an irregularly shaped portable easel, such as a portable easel shown in FIG. 16 having non-squared side wall 6" and bottom panel 8". Shims with different thicknesses can be provided for differently shaped portable easels.

Figure 17:
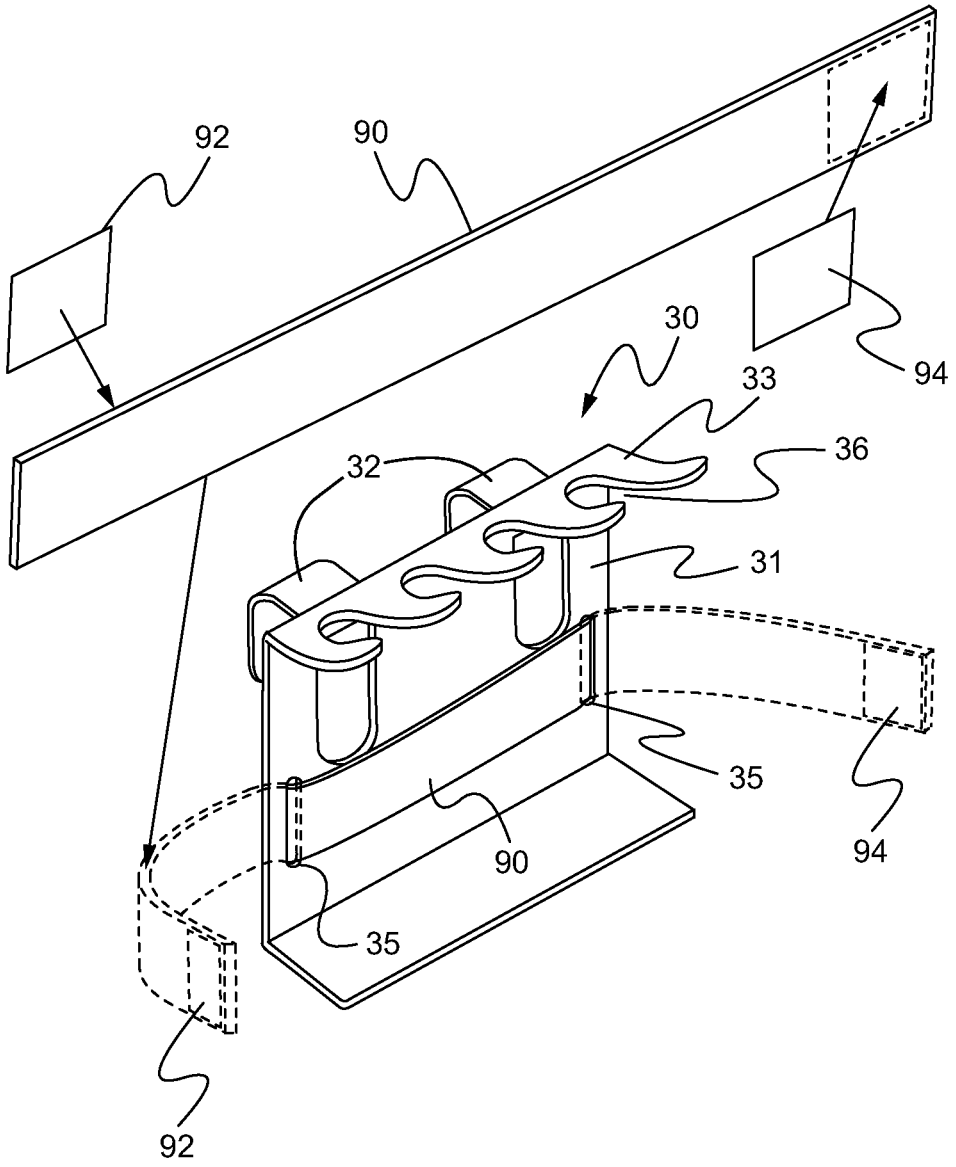
FIGS. 17-19 illustrate a front side perspective view of the carry case 30 of FIG. 2 with a single strap implementation according to an embodiment.
Figure 18:
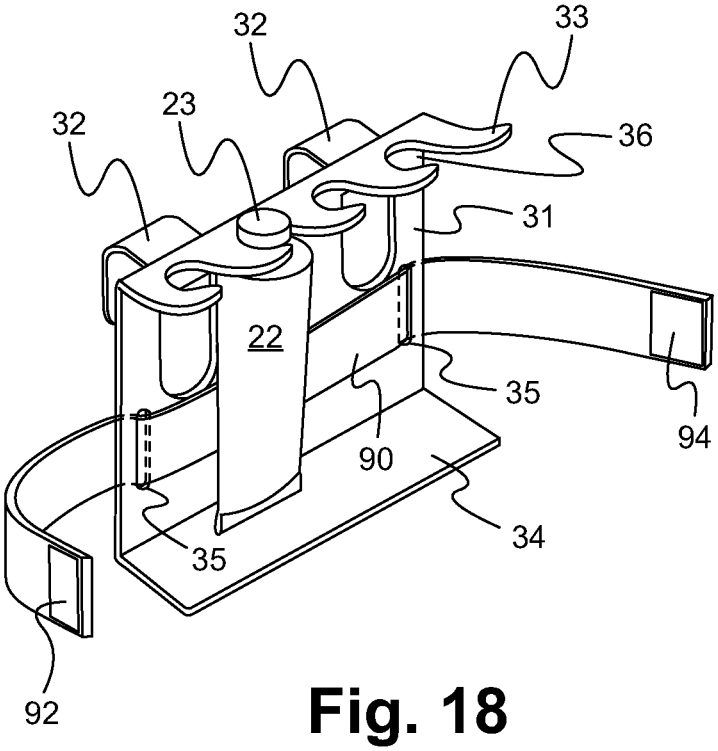
Figure 19:
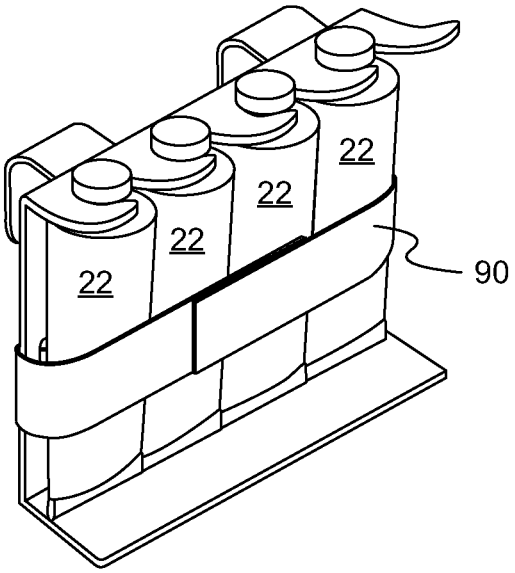

FIG. 17 illustrates a front side perspective view of the carry case 30 of FIG. 2 with a single strap implementation according to an embodiment. A strap 90 includes a loop patch 92 attached to a first surface of the strap 90 at or near a first end of the strap 90, and a hook patch 94 attached to a second surface of the strap 90 at or near a second end of the strap 90. The first end of the strap 90 is inserted through one of the slots 35 from the front side of the body 31 to the back side, and the second end of the strap 90 is inserted through the other slot 35 from the front side of the body 31 to the back side, as shown in FIG. 17. Once the strap 90 is attached to the body 31, a paint tube 22 is inserted into each of the notches 36, with the cap 23 of each paint tube 22 resting against the cornice 33, as shown in FIG. 18. The first end and the second end of the strap 90 are wrapped around the inserted paint tubes 22, and the loop patch 92 at the first end and the hook patch 94 at the second end are mated together to secure the strap 90 around the paint tubes 22 as shown in FIG. 19. It is also understood that alternative mechanisms can be used other than hook and loop for securing ends of a strap(s) together. Examples of such alternative mechanisms include, but are not limited to, magnets, stud and socket, clamp(s) and ties. A strap can be made of any conventional material capable of wrapping around the case as described above. Examples of strap material include, but are not limited to, leather, cloth, synthetic material, plastics or composites, such strap material capable of being either elastic or inelastic.

Figure 20:
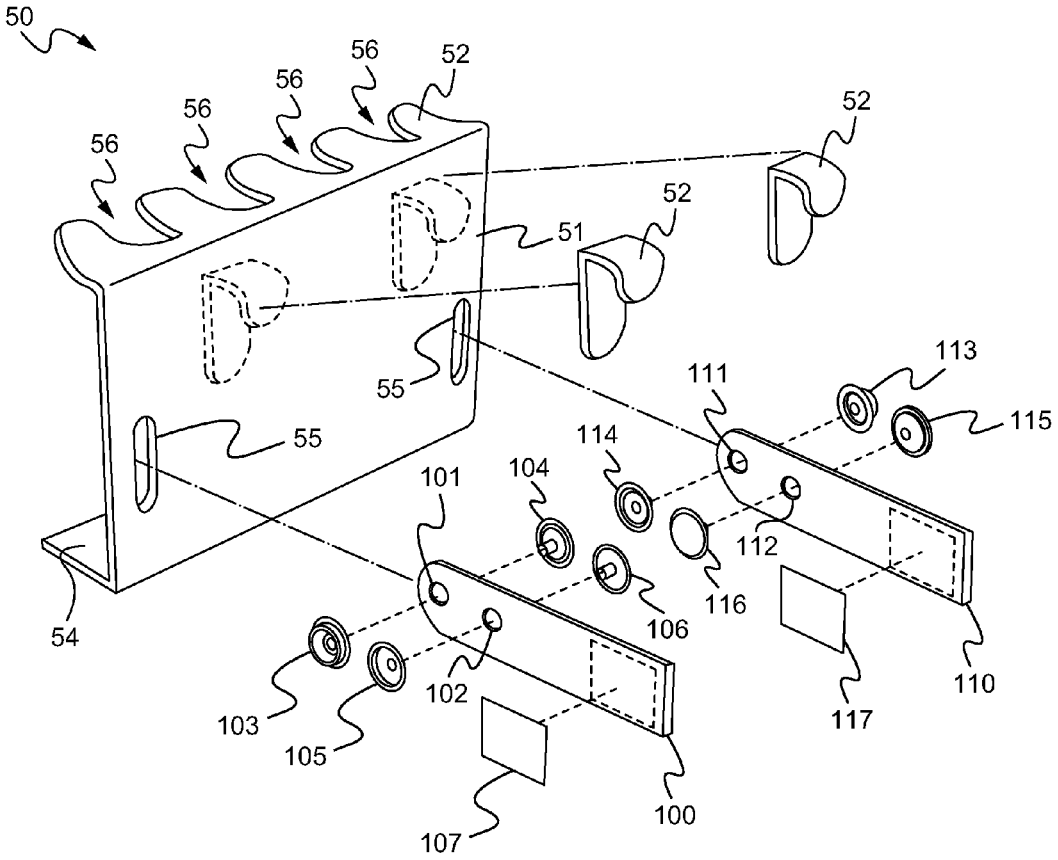
FIG. 20 illustrates a back side perspective view of the carry case 50 of FIG. 4 with a two strap implementation according to an embodiment.
Figure 21:
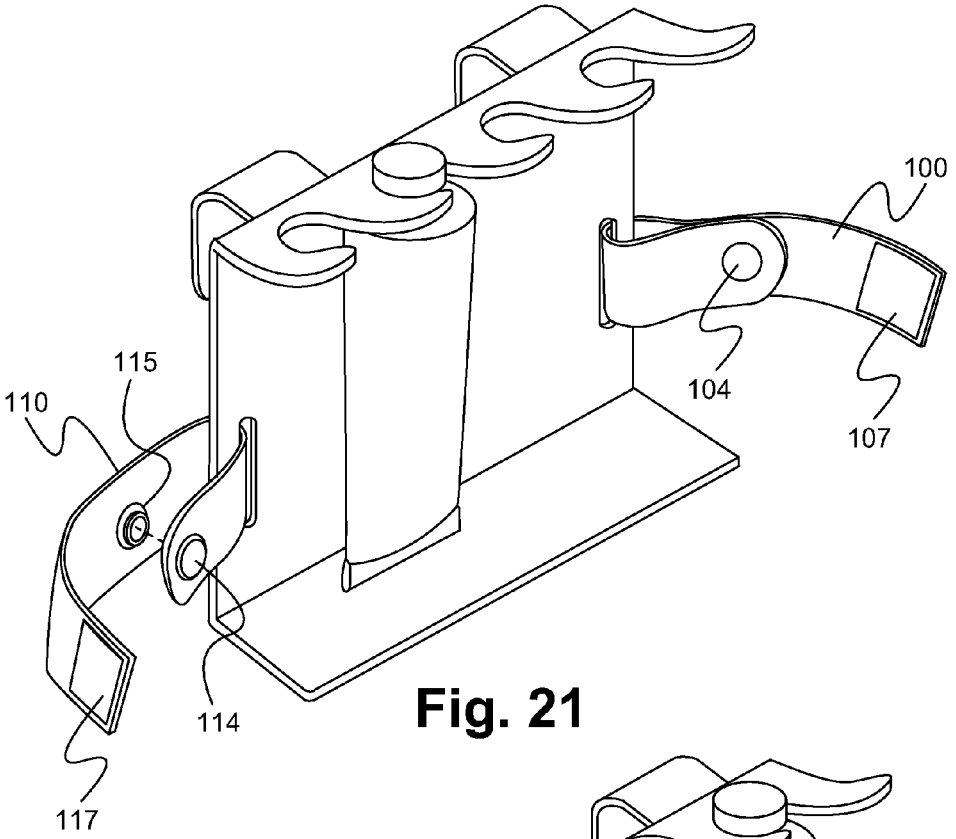
FIGS. 21-22 illustrate a front side perspective view of the carry case 50 of FIG. 4 with the two strap implementation according to an embodiment.
Figure 22:
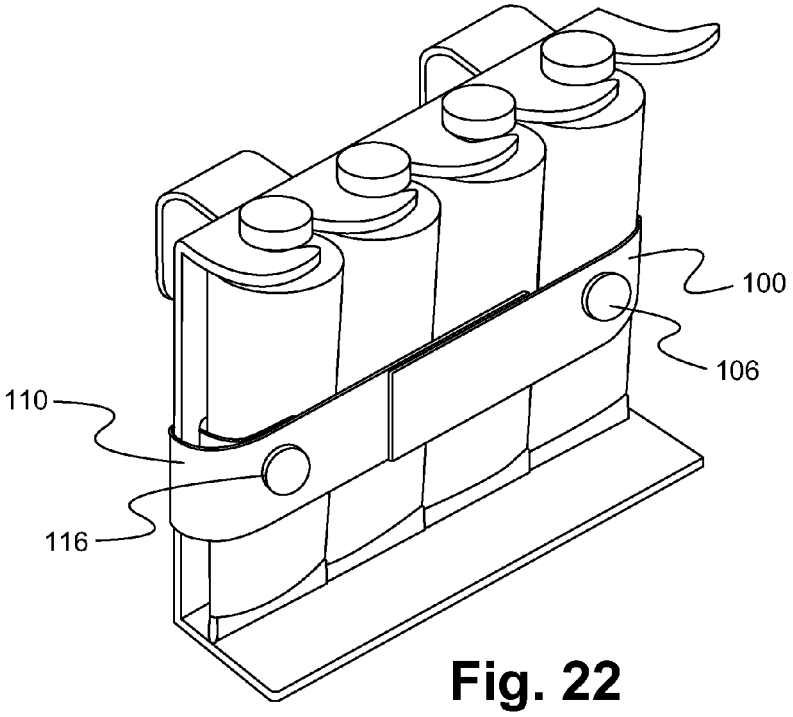

In other embodiments, multiple straps are attached to the carry case. FIG. 20 illustrates a back side perspective view of the carry case 50 of FIG. 4 with a two strap implementation according to an embodiment. A first strap 100 includes a hook patch 107 attached to a first surface of the first strap 100 at or near a first end of the first strap 100. The first strap 100 also includes a hole 101 through which a stud 103 and a fastener 104 are connected, and a hole 102 through which a socket 105 and a fastener 106 are connected. A second strap 110 includes a loop patch 117 attached to a first surface of the strap 110 at or near a first end of the second strap 100. The second strap 110 also includes a hole 111 through which a stud 113 and a fastener 114 are connected, and a hole 112 through which a socket 115 and a fastener 116 are connected. Either end of the strap 100 is inserted through one of the slots 55 until the stud 103 can be wrapped back to align with the socket 105, and either end of the strap 110 is inserted through the other slot 55 until the stud 113 can be wrapped back to align with the socket 115, as shown in FIG. 21. The stud 103 is snapped into the socket 105 to secure the strap 100 to the body 51, and the stud 113 is snapped into the socket 115 to secure the strap 110 to the body 51. The first end of the strap 110 and the first end of the strap 110 are wrapped around paint tubes inserted in the notches of the carry case, and the loop patch 117 and the hook patch 107 are mated together to secure the straps 100, 110 around the paint tubes as shown in FIG. 22. It is understood that alternative attachment mechanisms for attaching each strap to the body of the carry case can be used. It is also understood that alternative mechanisms can be used other than hook and loop for securing ends of a strap(s) together, such as those previously described.

Figure 23:
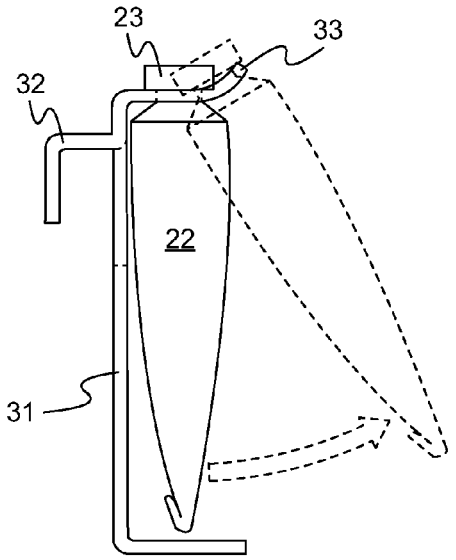
FIG. 23 illustrates an exemplary procedure for removing a paint tube from the carry case after the strap ends have been disengaged.

To remove paint tubes from the carry case, the hook patch and the loop patch are separated from each other and each paint tube is individually removed by swinging the bottom of the paint tube outward from the body, as shown in FIG. 23, and then pulling the neck of the paint tube from the notch.

Figure 24:
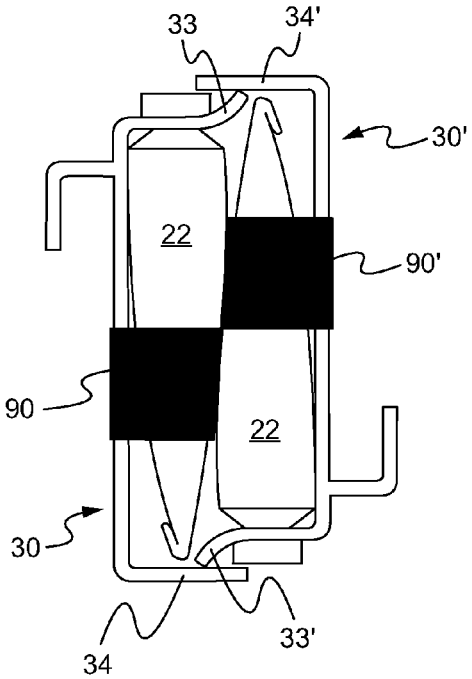
FIG. 24 illustrates two carry cases fitted together according to an embodiment.

The carry case is configured such that two carry cases can be easily fitted together for compact storage. FIG. 24 illustrates two carry cases fitted together according to an embodiment. The exemplary carry cases shown in FIG. 24 are each the same as the carry case 30 shown in FIG. 2. Carry case 30' is identical to carry case 30. To compactly fit the two carry cases together, one of the carry cases, carry case 30' in FIG. 24, is rotated 180 degrees relative to the other carry case, carry case 30. In this alignment, the tip of the cornice 33 of the carry case 30 is positioned against the base 34' of the carry case 30', and the tip of the cornice 33' of the carry case 30' is positioned against the base 34 of the carry case 30. The two fitted together carry cases 30, 30' can be stored in a protective bag 120, as shown in FIG. 25.

Figure 25:
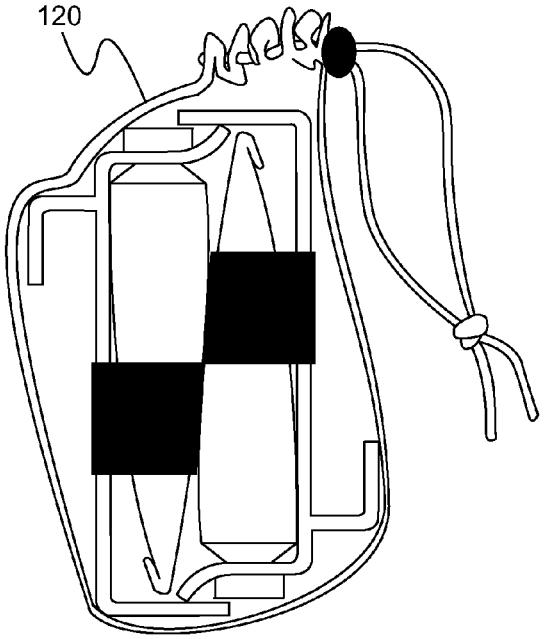
FIG. 25 illustrates two fitted together carry cases stored in a protective bag.
Figure 26:
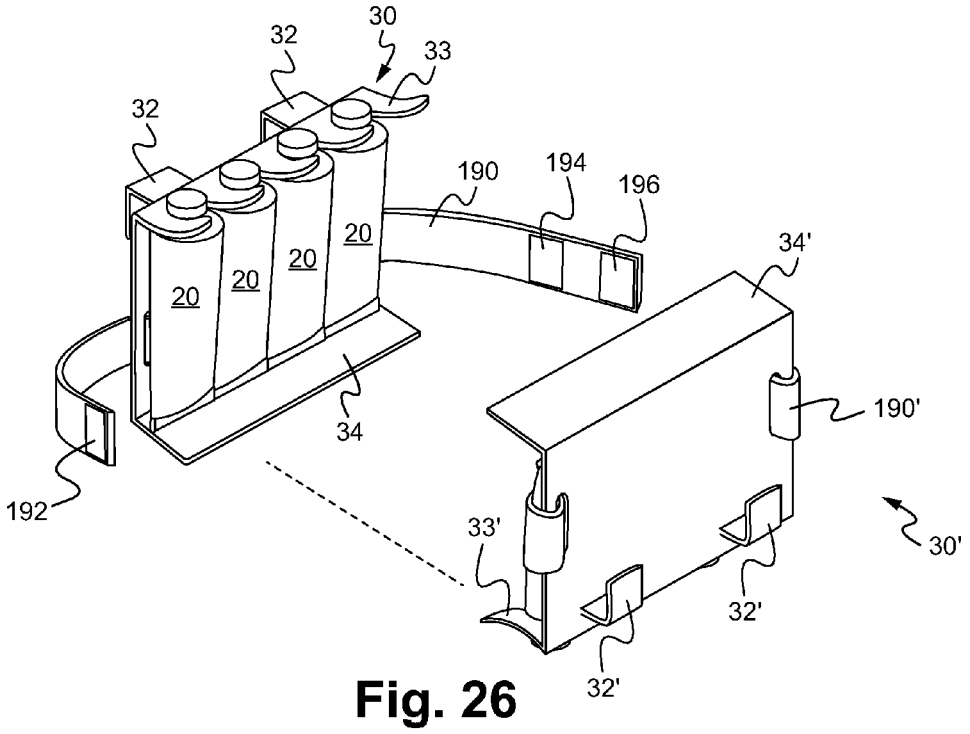
FIGS. 26-28 illustrate a perspective view of the carry case 30 of FIG. 2 with an elongated single strap for securing a pair of carry cases together according to an embodiment.
Figure 27:
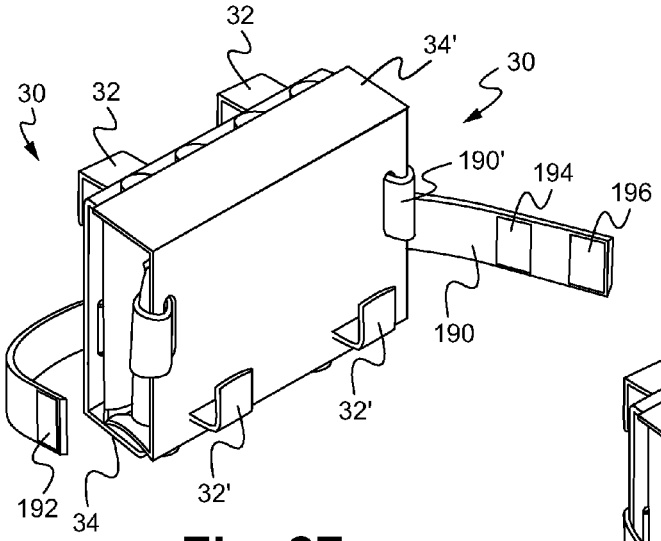
Figure 28:
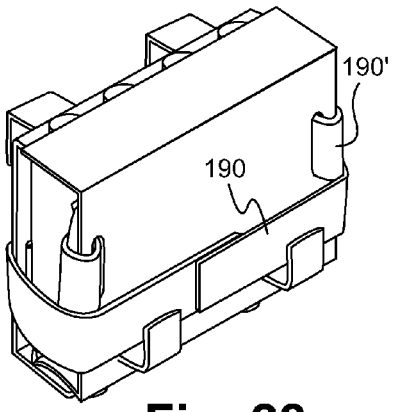

The embodiments above show the carry case having one or more straps configured to wrap around the paint tubes, and in such a configuration two carry cases can be fitted together for compact storage, as shown in FIGS. 24-25. In some embodiments, one or more of the straps are configured to be longer than those shown in the previous embodiments such that when two carry cases are fitted together the elongated strap of at least one carry case is long enough to wrap around the other carry case. FIG. 26 illustrates a perspective view of the carry case 30 of FIG. 2 where the strap 90 of FIG. 17 is replaced with a longer strap 190. The strap 190 includes a loop patch 192 and a hook patch 194. The strap 190 is similar in form and function to the strap 90 and is attached to the carry case 30 in a similar manner as that described in regard to the strap 90 in FIG. 17. The strap 190 can be used to wrap around the paint tubes 20 such that the loop patch 192 and the hook patch 194 are mated together to secure the strap 190 around the paint tubes 22, similar to that shown in FIG. 19, and as applied to the second carry case 30' shown in FIG. 26. The strap 190 also includes a second hook patch 196. The strap 190 is long enough such that when the second carry case 30' is fitted to the carry case 30, as shown in FIG. 27, both ends of the strap 190 wrap around the second carry case 30', and the loop patch 192 and the hook patch 196 are mated together to secure the strap 190 around the second carry case 190', as shown in FIG. 28. A strap 190' can be attached to the second carry case 30' with the strap 190' wrapped around paint tubes inserted into the second carry case 190', for example by mating loop patch 192' to hook patch 194'. Alternatively, a strap similar to the strap 90 in FIG. 17 can be attached to the second carry case 30' for securing the paint tubes inserted into the second carry case 30' It is understood that alternative mechanisms can be used other than hook and loop for securing ends of a strap(s) together. It is also understood that the two strap configuration can be similarly reconfigured such that one or both of the straps are made longer so as to wrap around two fitted carry cases.

The system utilizing the portable carry cases allows an artist to easily organize paint tubes of different colors, as well as protect them during transport and storage. While on location, set-up and takedown is quick and easy while refreshing the pallet with paint from the paint tubes during the session is more efficient without the distraction of bending over to search for any particular color. The frustration of missing colors, unidentifiable or cracked tubes of paint is reduced, if not eliminated. This system allows the artist to focus fully on the painting rather than the distractions of set-up, rummaging for colors, etc.

The present application has been described in terms of specific embodiments incorporating details to facilitate the understanding of the principles of construction and operation of the paint tube carry case. Many of the components shown and described in the various figures can be interchanged to achieve the results necessary, and this description should be read to encompass such interchange as well. As such, references herein to specific embodiments and details thereof are not intended to limit the scope of the claims appended hereto. It will be apparent to those skilled in the art that modifications can be made to the embodiments chosen for illustration without departing from the spirit and scope of the application.

What is claimed is:

1. A portable carry case for organizing and securing one or more objects in designated positions and for hanging the carry case in place, the carry case comprising:

a. a case having a body, a base extending from a front side and a first end of the body and a cornice extending from the front side and a second end of the body, wherein the cornice includes one or more notches, each notch configured to receive a corresponding one of the one or more objects mounted therein, further wherein the body includes a plurality of slots;

b. a plurality of hooks extending from a back side of the body; and c. one or more straps attached to the case at the plurality of slots, wherein the one or more straps are configured to wrap around the one or more objects mounted into the one or more notches to secure the one or more objects in place within the carry case.

2. The portable carry case of claim 1 wherein each object has a neck portion and a head portion coupled to the neck portion, wherein the head portion is wider than the neck portion and the neck portion is configured to slide within the notch of the cornice and the head portion is configured to rest against the cornice so that the object hangs within the carry case.

3. The portable carry case of claim 2 wherein the neck portion includes an opening at an end of the neck through which contents of the object are input and output, and the head portion comprises a cap configured to be removably coupled to the end of the neck.

4. The portable carry case of claim 1 wherein the notches of the cornice are an equidistant space apart from each other.

5. The portable carry case of claim 1 wherein the plurality of slots comprises two slots, each slot is positioned an equidistant space apart from side edges of the body.

6. The portable carry case of claim 1 wherein the plurality of hooks comprises two hooks, each hook is positioned an equidistant space apart from side edges of the body.

7. The portable carry case of claim 1 wherein the case is formed from a rectangular shaped sheet bent at a first end to form the cornice and bent at a second end to form the base.

8. The portable carry case of claim 1 wherein the cornice extends away from the body by a same distance as the base extends from the body.

9. The portable carry case of claim 1 wherein the one or more straps comprise a single strap, a first end of the strap includes a first fastener and a second end of the strap includes a second fastener to be mated to the first fastener, further wherein the strap is inserted through the plurality of slots to attach the strap to the carry case, and the first end of the strap and the second end of the strap wrap around the one or more objects mounted within the one or more notches such that the first fastener is mated to the second fastener.

10. The portable carry case of claim 9 wherein the first fastener comprises a loop patch and the second fastener comprises a hook patch.

11. The portable carry case of claim 1 wherein the one or more straps comprise two straps, a first end of the first strap includes a first fastener and a second end of the first strap includes a first fastener pair to be mated to each other, and a first end of the second strap includes a second fastener to be mated to the first fastener of the first strap and a second end of the second strap includes a second fastener pair to be mated to each other, further wherein the second end of the first strap is inserted through a first slot of the plurality of slots such that the first fastener pair are mated to each other to attach the first strap to the carry case, the second end of the second strap is inserted through a second slot of the plurality of slots such that the second fastener pair are mated to each other to attach the second strap to the carry case, and the first end of the first strap and the first end of the second strap wrap around the one or more objects mounted within the one or more notches such that the first fastener of the first strap is mated to the second fastener of the second strap.

12. The portable carry case of claim 1 wherein each hook comprises multiple mounting channels each having a different channel width for mounting to different sized mounting structures.

13. The portable carry case of claim 1 wherein the case comprises plastic or metal.

14. The portable carry case of claim 1 further comprising a removable shim mounted to the back side of the body.

15. The portable carry case of claim 1 wherein the plurality of hooks are integrally formed with the body.

16. The portable carry case of claim 1 wherein the plurality of hooks are separately formed from the body and are bonded to the body.

17. The portable carry case of claim 1 wherein the plurality of hooks are separately formed from the body and the body includes a plurality of hook slots, wherein a corresponding one hook of the plurality of hooks is inserted through a corresponding one of the plurality of hook slots.

18. A pair of portable carry cases for organizing and securing one or more objects in designated positions and for hanging each carry case in place, the pair of carry cases comprising:

a. a first carry case comprising:
   i. a first case having a first body, a first base extending from a front side and a first end of the first body and a first cornice extending from the front side and a second end of the first body, wherein the first cornice includes one or more first notches, each first notch configured to receive a corresponding one of the one or more objects mounted therein, further wherein the first body includes a plurality of first slots;
   ii. a plurality of first hooks extending from a back side of the first body; and
   iii. one or more first straps attached to the first case at the plurality of first slots, wherein the one or more first straps are configured with two fastening positions; and b. a second carry case comprising:
   i. a second case having a second body, a second base extending from a front side and a first end of the second body and a second cornice extending from the front side and a second end of the second body, wherein the second cornice includes one or more second notches, each second notch configured to receive a corresponding one of the one or more objects mounted therein, further wherein the second body includes a plurality of second slots;
   ii. a plurality of second hooks extending from a back side of the second body; and
   iii. one or more second straps attached to the second case at the plurality of second slots, wherein the one or more second straps are configured with two fastening positions;

wherein the second carry case is fitted against the first carry case with the one or more objects mounted in the first carry case facing the one or more objects mounted in the second carry case, the one or more second straps are wrapped around the one or more objects mounted into the one or more second notches to secure the one or more objects in place within the second carry case, and the one or more first straps are wrapped around the second carry case to secure together the first second carry case and the second carry case.

19. A portable carry case for organizing and securing one or more paint tubes in designated positions and for hanging the carry case in place against a side of a portable easel, wherein the portable easel comprises a bottom box with side walls, further wherein each of the one or more paint tubes includes a neck at one end of the paint tube, the neck having an opening at a first end for dispensing paint from the paint tube, and a cap removably coupled to the first end of the neck, the carry case comprising:

a. a case having a body, a base extending from a front side and a first end of the body and a cornice extending from the front side and a second end of the body, wherein the cornice includes one or more notches, each notch configured to receive the neck of a corresponding one of the one or more paint tubes mounted therein and the cap of the corresponding one paint tube rests against the cornice to suspend the corresponding one paint tube in place, further wherein the body includes a plurality of slots;

b. a plurality of hooks extending from a back side of the body, each hook configured to hang from a side wall of the portable easel; and c. one or more straps attached to the carry case at the plurality of slots, wherein the one or more straps are configured to wrap around the one or more paint tubes mounted into the one or more notches to secure the one or more paint tubes in place within the carry case.

* * * * *